US011242959B2

(12) United States Patent
Lu et al.

(10) Patent No.: US 11,242,959 B2
(45) Date of Patent: Feb. 8, 2022

(54) U-SHAPED LUMINAIRE

(71) Applicant: Xiamen PVTECH Co., Ltd., Fujian (CN)

(72) Inventors: Fuxing Lu, Fujian (CN); Weibiao Zhong, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 16/899,531

(22) Filed: Jun. 11, 2020

(65) Prior Publication Data

US 2021/0222840 A1 Jul. 22, 2021

(30) Foreign Application Priority Data

Jan. 21, 2020 (CN) ..... 202010071990.3

(51) Int. Cl.

| | |
|---|---|
| ***F21K 9/275*** | (2016.01) |
| ***F21K 9/272*** | (2016.01) |
| ***F21V 17/16*** | (2006.01) |
| ***F21V 19/00*** | (2006.01) |
| ***F21V 23/02*** | (2006.01) |
| ***F21Y 103/37*** | (2016.01) |
| ***F21Y 103/10*** | (2016.01) |
| ***F21Y 115/10*** | (2016.01) |

(52) U.S. Cl.

CPC ..... *F21K 9/275* (2016.08); *F21K 9/272* (2016.08); *F21V 17/164* (2013.01); *F21V 19/0075* (2013.01); *F21V 23/02* (2013.01); *F21Y 2103/10* (2016.08); *F21Y 2103/37* (2016.08); *F21Y 2115/10* (2016.08)

(58) Field of Classification Search

CPC ..... F21Y 2103/37; F21V 3/02; F21S 4/28; F21K 9/232; F21K 9/235; F21K 9/275; F21K 9/272

See application file for complete search history.

(56) References Cited

U.S. PATENT DOCUMENTS

| | | | | |
|---|---|---|---|---|
| 9,982,872 | B1 * | 5/2018 | Kearney | F21S 8/061 |
| 10,288,272 | B2 * | 5/2019 | Yao | F21K 9/272 |
| 10,883,669 | B2 * | 1/2021 | Brown | F21V 5/04 |

* cited by examiner

*Primary Examiner* — Matthew J. Peerce

(74) *Attorney, Agent, or Firm* — Winston Hsu

(57) ABSTRACT

The present invention provides a U-shaped luminaire, comprises a lamp head module, a first glass tube, a second glass tube, a first light source board, a second light source board and a light transmission module, said lamp head module engaging said first glass tube and said second glass tube respectively, said first light source board being located within said first glass tube, said second light source board being located within said second glass tube and said light transmission module engaging said first glass tube and said second glass tube respectively.

8 Claims, 2 Drawing Sheets

U-SHAPED LUMINAIRE

CROSS REFERENCE TO RELATED APPLICATION

This application claims priority to China Patent Application No. 202010071990.3, filed 2020 Jan. 21, and included herein by reference in its entirety.

BACKGROUND OF THE INVENTION

1. Field of the Invention

The present invention relates to a luminaire and in particular to a U-shaped luminaire.

2. Description of the Prior Art

Existing fluorescent lamps, whether fluorescent or light-emitting diode (LED), inevitably create illuminated dead spots or light shadows.

In addition, a small number of lamps are made from non-combustible, safer plastic materials, so the cost of manufacturing such lamps is high.

Therefore, how to design a lighting fixture without lighting dead spots or shadows, non-combustible, high safety and low manufacturing cost, and to meet the needs of wide angle illumination, is a topic that needs to be improved by those involved in this field.

SUMMARY OF THE INVENTION

To this objective, the present invention provides a U-shaped luminaire, without lighting dead spots or shadows, non-combustible, high safety and low manufacturing costs, and can meet the needs of wide angle illumination.

To achieve the above purpose, the inventor provides a U-shaped luminaire, comprises a lamp head module, a first glass tube, a second glass tube, a first light source board, a second light source board and a light transmission module, said lamp head module being engaged with said first glass tube and said second glass tube respectively, said first light source board being located within said first glass tube, said second light source board being located within said second glass tube and said light transmission module being engaged with said first glass tube and said second glass tube respectively.

In some embodiments, said lamp head module comprises a first lamp head, a first socket, a connector, a second lamp head and a second socket, said first socket being located at said first lamp head, said first lamp head engaging said first glass tube, said first socket electrically connecting said first light source board, said second socket being located at said second lamp head, said second lamp head engaging said second glass tube, said second socket electrically connecting said second light source board, said connector being coupled to said first lamp head and said second lamp head respectively.

In some embodiments, said first light head has a first power supply circuit within said first light head, said first power supply circuit being electrically connected to said first socket and said first light source board, respectively.

In some embodiments, a second power supply circuit is provided within said second light head, said second power supply circuit being electrically connected to said second socket and said second light source board, respectively.

In some embodiments, said second connection terminal is a male terminal, said first lamp head and said second lamp head are made of light-transmitting plastic.

In some embodiments, said first light source board and said second light source board have a board and a plurality of light emitting diodes mounted on the board, respectively.

In some embodiments, said light transmission module has an upper housing and a lower housing, said upper housing and said lower housing being combined in a snap-on manner.

In some embodiments, a third light source board is provided within said light transmission module, said third light source board being electrically connected to said first light source board and said second light source board, respectively.

In some embodiments, said third light source board has a board and a plurality of light emitting diodes mounted on the board; said U-shaped luminaire is electrically coupled to an AC power source or is used in an energy-saving lamp base.

In some embodiments, said light transmission module comprises a transparent housing made of polycarbonate.

It is worth mentioning that the first glass tube and the second glass tube are made of glass material, glass lamps are low cost, non-flammable and safe. The light transmission module has a transparent housing, and the first and second lamp heads are made of translucent plastic, so that the light diffuses without shadows. The third light source board and the first light source board and the second light source board are docked tightly, and the lamp corner position no shadow, so the whole lamp light even and no dark area. The upper and lower housings of the light transmission module are combined in a snap-on manner, eliminating the need for screw locking.

These and other objectives of the present invention will no doubt become obvious to those of ordinary skill in the art after reading the following detailed description of the preferred embodiment that is illustrated in the various figures and drawings.

DETAILED DESCRIPTION

In order to elaborate the technical content of the technical scheme, structural features, the achieved purpose and effect, the following combined with specific implementation examples and with the accompanying drawings are described in detail.

Figure 1:
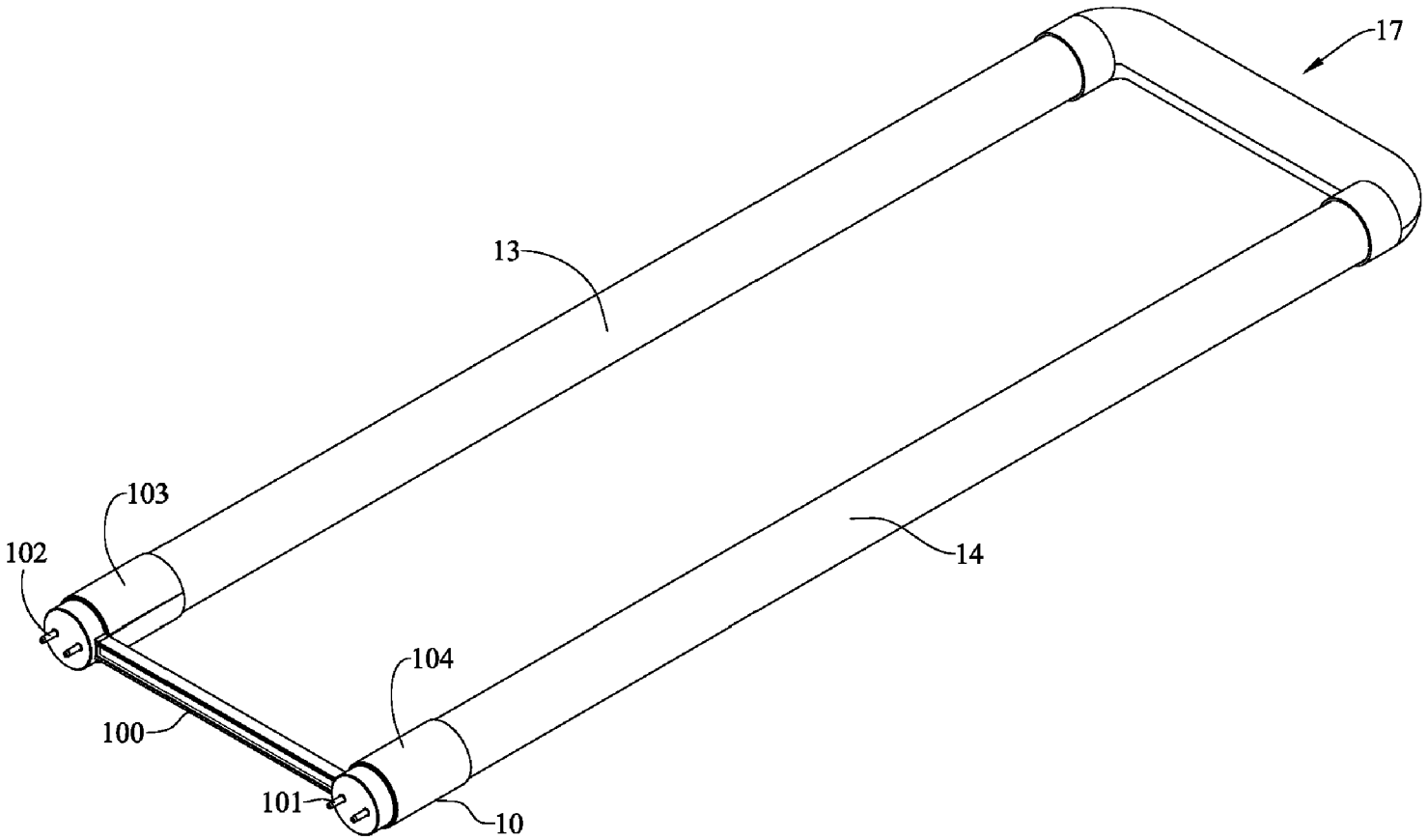
FIG. 1 illustrates a perspective view of a U-shaped luminaire according to the present invention.
Figure 2:
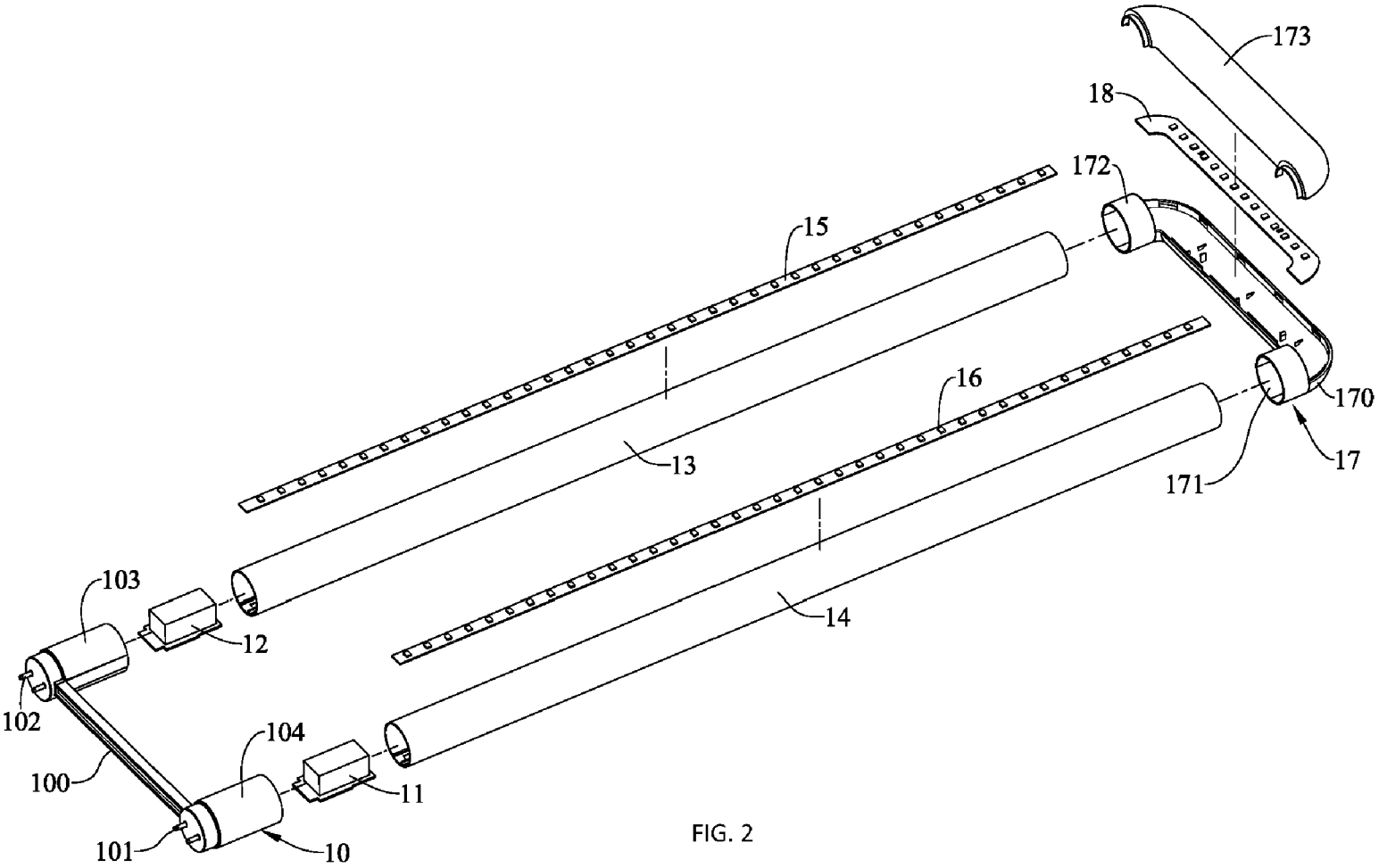
FIG. 2 illustrates a explosive view of the U-shaped luminaire according to the present invention.

Please refer to FIGS. 1 to 2 for a perspective view and an explosive view of the U-shaped luminaire according to the present invention.

This application provides a U-shaped luminaire comprising: a lamp head module 10, a first power supply circuit 12, a second power supply circuit 11, a first glass tube 13, a second glass tube 14, a first light source board 15, a second light source board 16, alight transmission module 17 and a third light source board 18.

The lamp head module 10, comprising: a first lamp head 103, a first socket 102, a connector 100, a second lamp head 104 and a second socket 101.

The first socket 102 is located at the first lamp head 103, which has an open end. The second socket 101 is located at the second lamp head 104, which has an open end. The connector 100 is connected to the first lamp head 103 and the second lamp head 104 respectively. The first socket 102 and the second socket 101 are commercially available R17D or FA8 sockets. The first lamp head 103 and the second lamp head 104 are made of light-transmitting plastic, e.g. Polycarbonate (PC).

The first power supply circuit 12 is located inside the first lamp head 103 and is electrically connected to the first socket 102. The second power supply circuit 11 is located inside the second lamp head 104 and is electrically connected to the second socket 101.

The first glass tube 13 is a glass tube body having openings at both ends. The first lamp head 103 is located at the opening at one end of the first glass tube 13. Preferably, the open end of the first lamp head 103 is an opening where the first glass tube 13 is joined.

The second glass tube 14 is a glass tube body having openings at both ends. The second lamp head 104 is located at the opening at one end of the second glass tube 14. Preferably, the open end of the second lamp head 104 is an opening in which the second glass tube 14 is joined.

The first light source board 15 has a board and a plurality of light emitting diodes (LEDs) mounted on the board. The first light source board 15 is located inside the first glass tube 13. The first light source board 15 is electrically connected to the first power supply circuit 12.

The second light source board 16 has a board and a plurality of light emitting diodes (LEDs) mounted on the board. The second light source board 16 is located inside the second glass tube 14. The second light source board 16 is electrically connected to the second power supply circuit 11.

The light transmission Module 17 comprises a transparent housing made of polycarbonate (PC). The light transmission module 17 has an upper housing 173 and a lower housing 170, wherein the upper housing 173 and the lower housing 170 are combined in a snap-on manner, for example, the upper housing 173 has a snap hook, the lower housing 170 has a snap slot, and the snap hook of the upper housing 173 snaps into the snap slot of the lower housing 170 so that the lower housing 170 and the upper housing 173 are combined.

The lower housing 170 further has a first lower opening 172 and a second lower opening 171, wherein the lower housing 170 is coupled to the first glass tube 13 and the second glass tube 14, respectively. Namely, the first lower opening 172 is an opening for joining the first glass tube 13. The second lower opening 171 is an another opening for joining the second glass tube 14.

The third light source board 18 has a board and a plurality of light emitting diodes (LEDs) mounted on the board. The third light source board 18 is located inside the light transmission module 17 and the third light source board 18 is electrically connected to the first light source board 15 and the second light source board 16, respectively. Namely, the third light source board 18 is located in the lower housing 170 and is located between the first lower opening 172 and a second lower opening 171, the upper housing 173 being covered above the third light source board 18.

The first socket 102 and the second socket 101 are electrically connected to a power supply. The first light source board 15, the second light source board 16 and the third light source board 18 are then illuminated and provided with power through the first socket 102, the second socket 101, the first power supply circuit 12 and the second power supply circuit 11.

The U-shaped luminaire of this application may have two operational modes; mode A, wherein the U-shaped luminaire of this application may directly replace an existing lamp in an energy-saving lamp base (with an electronic rectifier); mode B, wherein the application may be directly electrically connected to an alternating current (AC electric supply).

In summary, the advantages that can be achieved by the U-shaped luminaire of this application are: first, the first glass tube 13 and the second glass tube 14 are made of glass, the glass tube is low cost, non-combustible, high safety; second, the first lamp head 103 and the second lamp head 104 are made of translucent plastic, and the light transmission module 17 has a transparent housing, so the light diffuses without shadow; third, the third light source board 18 and the first light source board 15 and the second light source board 16 are docked closely, and the corner position of the lamp (adjacent to the first lower opening 172 and the second lower opening 171 of the lower housing 170) without shadow, so the U-shaped luminaire of this application has the advantage of even light emission and no dark area; fourth, the upper housing 173 and the lower housing 170 of the light transmission module 17 are connected by way of a snap-on manner, without the use of screw lock.

It should be noted that although each of these embodiments has been described herein, it does not thereby limit the scope of patent protection of the present invention. Accordingly, changes and modifications to implementations described herein based on the innovative concept of the present invention, or equivalent structure or equivalent process transformations using the contents of the specification of the invention and the accompanying drawings, and the direct or indirect application of the above technical solutions to other related fields of technology are included in the scope of patent protection of the present invention.

The present invention provides a U-shaped luminaire, comprises a lamp head module, a first glass tube, a second glass tube, a first light source board, a second light source board and a light transmission module, said lamp head module engaging said first glass tube and said second glass tube respectively, said first light source board being located within said first glass tube, said second light source board being located within said second glass tube and said light transmission module engaging said first glass tube and said second glass tube respectively.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A U-shaped luminaire, comprises a lamp head module, a first glass tube, a second glass tube, a first light source board, a second light source board and a light transmission module, said lamp head module being connected to said first glass tube and said second glass tube respectively, said first light source board being located inside said first glass tube, said second light source board being located inside said second glass tube, said light transmission module has an upper housing and a lower housing, said upper housing and said lower housing being combined in a snap-on manner, wherein said lower housing has a first ring body having a first lower opening and a second ring body having a second lower opening, wherein said first glass tube is inserted into said first lower opening and said second glass tube is inserted into said second lower opening, whereby said light transmission module is connected to said first glass tube and said second glass tube; and a third light source board inside the light transmission module, the third light source board being electrically connected to the first light source board and the second light source board respectively.

2. The U-shaped luminaire as claimed in claim 1, wherein said lamp head module comprises a first lamp head, a first socket, a connector, a second lamp head and a second socket, said first socket being set at said first lamp head, said first lamp head joining said first glass tube, said first socket electrically connecting said first light source board, said second socket being set at said second lamp head, said second lamp head joining said second glass tube, said second socket electrically connecting said second light source board, said connector being coupled to said first lamp head and said second lamp head respectively.

3. The U-shaped luminaire as claimed in claim 2, further comprises a first power supply circuit within the first luminaire head, the first power supply circuit being electrically connected to the first socket and the first light source board respectively.

4. The U-shaped luminaire as claimed in claim 2, further comprises a second power supply circuit within the second lamp head, the second power supply circuit being electrically connected to the second socket and the second light source board respectively.

5. The U-shaped luminaire as claimed in claim 2, wherein the first lamp head and the second lamp head are made of translucent plastic.

6. The U-shaped luminaire as claimed in claim 1, wherein the first light source board and the second light source board having a board and a plurality of light emitting diodes mounted on the board, respectively; the U-shaped luminaire is electrically coupled to an AC power supply or is used in an energy-saving lamp base.

7. The U-shaped luminaire as claimed in claim 1, wherein the third light source board having a board and a plurality of light emitting diodes mounted on the board.

8. The U-shaped luminaire as claimed in claim 1, wherein the light transmission module comprises a transparent housing made of polycarbonate.

* * * * *